US006357714B1

(12) United States Patent
Johnson

(10) Patent No.: US 6,357,714 B1
(45) Date of Patent: Mar. 19, 2002

(54) CEILING FAN WITH MULTIPLE DOWNRODS

(75) Inventor: Aaron Mitchell Johnson, Fort Worth, TX (US)

(73) Assignee: Quorum International, L.P., Fort Worth, TX (US)

( * ) Notice: Subject to any disclaimer, the term of this patent is extended or adjusted under 35 U.S.C. 154(b) by 0 days.

(21) Appl. No.: 09/477,987

(22) Filed: Jan. 5, 2000

(51) Int. Cl.[7] ..... B42F 13/00
(52) U.S. Cl. ..... 248/343; 416/244 R
(58) Field of Search ..... 248/343, 317, 248/342, 344; 416/244 R, 246

(56) References Cited

U.S. PATENT DOCUMENTS 4,448,388 A * 5/1984 Dennis et al. ..... 248/663
5,090,654 A * 2/1992 Ridings et al. ..... 248/343
5,725,190 A * 3/1998 Cuthbertson et al. ..... 248/343
5,947,436 A * 9/1999 Bucher et al. ..... 248/343 X
5,951,253 A 9/1999 Gajewski ..... 416/214 R
6,017,190 A * 1/2000 Lackey ..... 416/244 R
6,116,559 A * 9/2000 Lackey ..... 248/343

* cited by examiner

*Primary Examiner*—Ramon O. Ramirez
(74) *Attorney, Agent, or Firm*—Kenneth C. Hill; Hill & Hunn, LLP

(57) ABSTRACT

A ceiling fan support system is provided which contains multiple, perimeter downrods connected between a ceiling fan housing and supporting structure attached to a ceiling. The perimeter rods may provide some or all of the supporting structure to suspend the ceiling fan housing. In order to accommodate sloped ceilings, the perimeter downrods may be made of adjustable length.

19 Claims, 2 Drawing Sheets

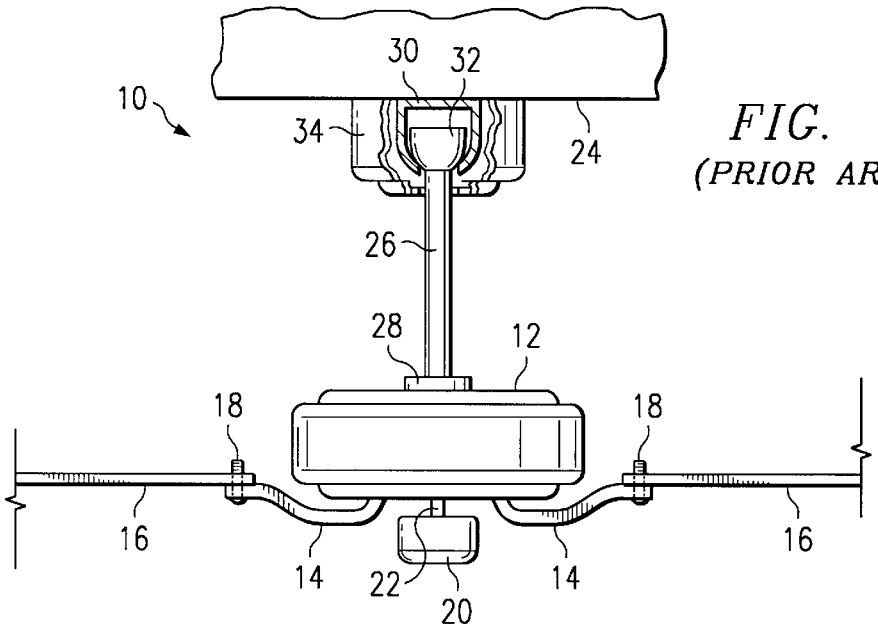
FIG. 1
(PRIOR ART)
FIG. 2
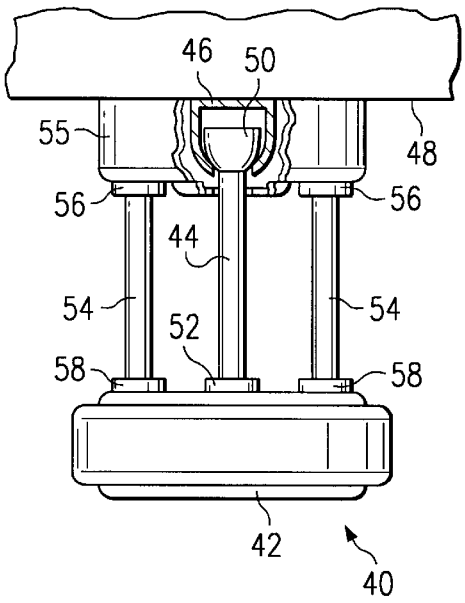
FIG. 3
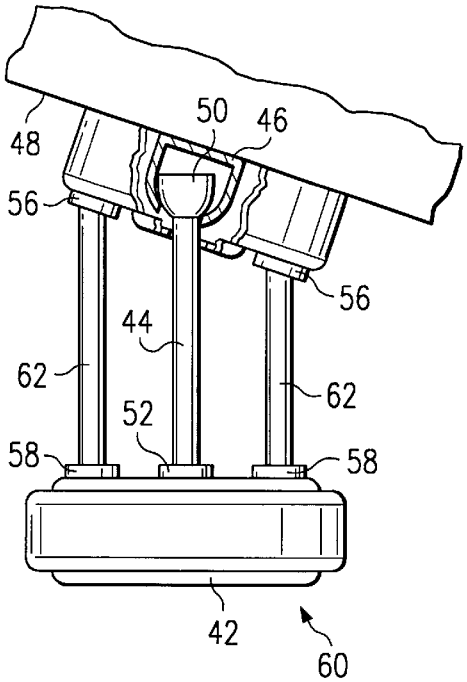

CEILING FAN WITH MULTIPLE DOWNRODS

BACKGROUND OF THE INVENTION

1. Field of the Invention

The present invention relates generally to electric ceiling fans, and more specifically to a decorative support structure for a ceiling fan which includes multiple downrods.

2. Description of the Prior Art

As is well known in the art, ceiling fans may be attached to a ceiling using any of several different techniques. Perhaps the most common technique is to suspend the ceiling fan motor and housing from a single downrod. This prior art approach is illustrated in FIG. 1.

Referring to FIG. 1, a prior art ceiling fan structure includes a decorative motor housing 12 which houses a ceiling fan motor (not shown) as known in the art. Brackets 14, of which only two are shown in FIG. 1, are attached to the rotor of the ceiling fan motor. Blades 16 are attached to brackets 14 by bolts or other attachment means as known in the art.

In a typical ceiling fan, a switch housing 20 depends from motor housing 12 through an extension rod 22. Typically, switch-housing 20 contains switches for turning the ceiling fan on, and controlling its speed and direction. Also, a decorative light fixture (not shown) is often connected to switch housing 20.

Motor housing 12 is supported from ceiling 24 by a downrod 26. Downrod 26 is connected to fan housing 12 by an attachment bracket 28 as well known in the art. Power for the fan motor and lights is carried via electric wires which pass through downrod 26.

Downrod 26 is connected to ceiling 24 through a bracket 30 and a ball-joint member 32. Ball-joint member 32 is free to move, in a limited range, with respect to bracket 30. This allows the downrod 26 to hang vertically if bracket 30 is attached to a sloped ceiling and allows a certain freedom of movement of the fan housing 12 during operation. Bracket 30 is generally covered by a decorative canopy 34, which has an opening in the bottom for passage of downrod 26.

Variations on this general design have been manufactured. One example is shown in U.S. Pat. No. 5,951,253, by Mark Gajewski, which shows three small downrods used for decorative effect. However, these downrods are all connected together into a single unit, and have the same physical function as single downrod 26.

It would be desirable to provide a ceiling fan down rod arrangement which gave a different aesthetic effect to the ceiling fan unit, and which provided proper support for the fan.

SUMMARY OF THE INVENTION

In accordance with the present invention, a ceiling fan support system is provided which contains multiple, perimeter downrods connected between a ceiling fan housing and supporting structure attached to a ceiling. The perimeter rods may provide some or all of the supporting structure to suspend the ceiling fan housing. In order to accommodate sloped ceilings, the perimeter downrods may be made of adjustable length.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 is a partially sectional view of a prior art ceiling fan structure;

FIG. 2 is a partially sectional view of a ceiling fan support structure in accordance with the present invention;

FIG. 3 is a partially sectional view of a ceiling fan support structure attached to a sloping ceiling;

DESCRIPTION OF THE PREFERRED EMBODIMENT

Figure 4:
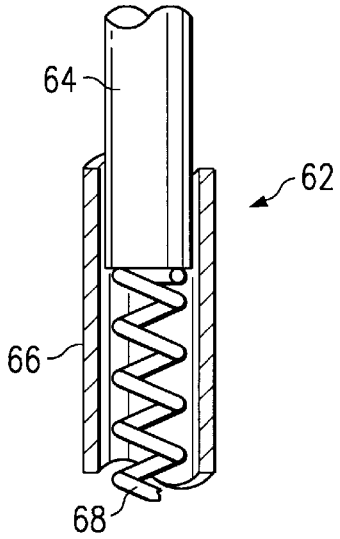
FIG. 4 is a sectional view of a portion of an adjustable length downrod.

Ceiling fans come in a wide variety of styles, sizes, number of blades, and so forth. It will be understood by those skilled in the art that the present invention can generally be applied to most, if not all, of this wide variety of styles.

Referring to FIG. 2, a ceiling fan and support structure 40 are illustrated. For simplicity of illustration, the ceiling fan blades, light fixture, and similar additional structures which do not form part of the present invention are not shown.

The ceiling fan motor is contained in housing 42. A downrod 44 is suspended from a bracket 46 which is fixedly attached to a ceiling 48 in any manner known by those skilled in the art. Downrod 44 is preferably connected to bracket 46 by ball joint member 50, which allows downrod 44 limited movement in three dimension with respect to bracket 46. Downrod 44 is connected to motor housing 42 by a bracket 52 as known in the art.

Description of the ceiling fan and support structure 40 to this point has been essentially conventional. However, in addition to a central downrod 44, multiple perimeter downrods 54 are also provided. Only two perimeter downrods 54 are shown in FIG. 2; however, a typical installation would have at least 4 perimeter downrods 54 equally spaced around central downrod 44. Perimeter downrods 54 are connected to a canopy 55 by brackets 56, and to the fan housing 42 by brackets 58.

In the embodiment of FIG. 2, the upper ends of perimeter downrods 54 are attached only to a decorative canopy 55. In this type of structure, typically central downrod 44 will actually carry the weight of fan housing 42 and its attached fixtures and hardware. In this manner, perimeter downrods 54 serve primarily, or entirely, a decorative function. However, if canopy 55 is relatively substantial, or downrods 54 are connected to an extended portion of bracket 46 or some other fixed piece of hardware, a portion of the weight of the fan can be carried by perimeter downrods 54.

The wires used to carry power to the fan motor and lights would typically be run through the central downrod 44, in the same manner as the prior art. If desired, however, wires can be run through one or more perimeter downrods as well. This allows a light fixture to be attached to the perimeter downrods and other upper portions of the structure, as well as providing an alternative path for the wiring used to carry current to the fan motor.

If ceiling 48 is known to be horizontal, perimeter downrods 54 can be simply fixed length rods. However, if the ceiling 48 may be sloped, provision will need to be made for perimeter downrods 54 of variable length. Such a situation is shown in connection with FIG. 3.

Referring to FIG. 3, ceiling fan support structure 60 includes many of the same elements as shown in FIG. 2. However, perimeter downrods 62 are designed to be adjustable in length. It would be possible, of course, to provide fixed length downrods of varying lengths, but this would require that the slope of ceiling 48 be known in advance. In the preferred embodiment, perimeter downrods 62 have an individually adjustable length.

In the preferred embodiment, downrods 62 are spring loaded and telescoping. The weight of the fan housing 42 will pull downrod 44, the primary weight supporting structure, into a vertical alignment. Each of the perimeter downrods 62 will then self-adjust to the appropriate length.

FIG. 4 shows a cut-away of a portion of a perimeter downrod 62. Each perimeter downrod 62 contains an upper portion 64 and a lower portion 66. A spring 68, which is not a strong spring, places the rod 62 under a small amount of tension and may be also used to keep the upper and lower portions 64, 66 together. In many installations, it will not be necessary to include a spring 68, but merely to allow the upper and lower portions of the perimeter rod 62 to move with respect to each other so that the overall length of perimeter rod 62 can self-adjust as shown in FIG. 3.

Figure 5:
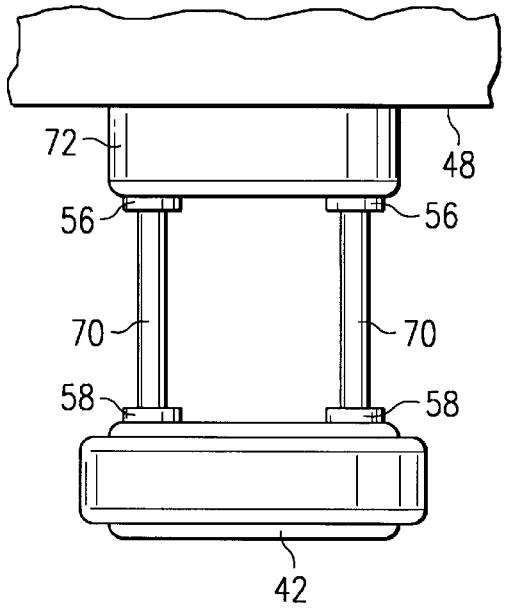
FIG. 5 is a side view of a portion of an alternative embodiment of a ceiling fan support structure.

An alternative embodiment of the present invention is illustrated in FIG. 5. In this embodiment, no central downrod is provided. Instead, all of the weight of motor housing 42 and its attached fixtures are borne by perimeter downrods 70. Canopy 72 is attached to the ceiling, and is strong enough to bear the weight of the ceiling fan and attached structures through perimeter downrods 70. Downrods 70 are preferably of fixed length, so that fan housing 42 is held in a fixed position. In this type of arrangement, the power lines for the fan must, of course, be conducted through one or more of the perimeter downrods 70 because the central downrod has been removed.

Figure 6:
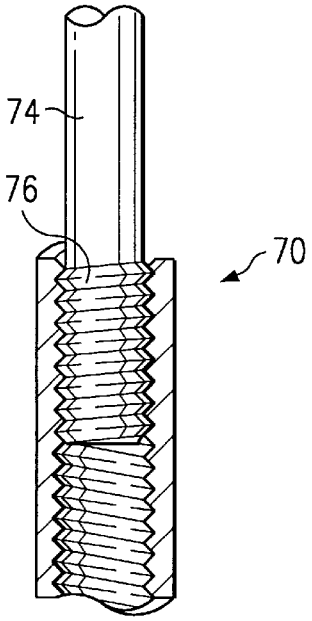
FIG. 6 is a sectional view of an adjustable length downrod.

In order to accommodate ceilings which may not be horizontal, it is preferable to provide downrods which can be adjusted to a selected length and fixed at that length. Such a downrod could also, of course, be used with the support structure 60 to accommodate a sloped ceiling as shown in FIG. 3. One approach for such a downrod is shown in FIG. 6, in which an upper portion 74 and lower portion 76 are threaded so that they engage each other within larger, lower portion 76. By turning the upper and lower portions 74, 76 with respect to each other, the overall length of downrod 70 can be adjusted. Some mechanism for fixing the overall length of downrod 70 when it has been adjusted must be provided, such as through the use of a cotter pin (not shown) with prevents the upper and lower portions 74, 76 from being rotated relative to each other. Other techniques well known in the art, such as using one or more pins or set screws, may also be used.

In general, any technique for fixing the length of perimeter downrods 70 may be used. Various types of clamps, bolts, and similar structures may be used if desired. Preferably, a mechanical technique is used which may be hidden within downrods 70 so as not to spoil their decorative effect.

In summary, various embodiments of the present invention include multiple perimeter downrods which are connected between an upper canopy or support structure and a ceiling fan housing. These may be used with or without a traditional central supporting downrod, but must be capable of supporting the weight of the fan structure if the central downrod is eliminated. Preferably, perimeter downrods which are self-adjusting in length are used to accommodate a sloped ceiling. The resulting structure provides an agreeable, novel and interesting decorative effect when compared to traditional ceiling fan supporting structures. In addition, wiring can be routed through the perimeter downrods if desired or necessary to simplify design of the ceiling fan housing.

While the invention has been particularly shown and described with reference to a preferred embodiment, it will be understood by those skilled in the art that various changes in form and detail may be made therein without departing from the spirit and scope of the invention.

What is claimed is:

1. A decorative support for a ceiling fan, comprising:

a motor housing;

an attachment device adapted for fixedly mounting on a ceiling, wherein the attachment device includes a hangar bracket and a decorative canopy around the hangar bracket;

a central downrod suspended from the hangar bracket at a first connection point and connected to the motor housing at a second connection point; and a plurality of perimeter downrods connected to the canopy at a corresponding plurality of first perimeter connection points spaced from the first connection point and to the motor housing at a corresponding plurality of second connection points spaced from the second connection point.

2. The decorative support of claim 1, wherein the plurality of perimeter downrods comprises at least 4 downrods.

3. The decorative support of claim 1, wherein each of the perimeter downrods is spaced the same distance from the central downrod.

4. The decorative support of claim 1, wherein wires for supplying electrical power are routed through the central downrod.

5. The decorative support of claim 1, wherein wires for supplying electrical power are routed through at least one of the perimeter downrods.

6. The decorative support of claim 1, wherein the perimeter downrods have adjustable lengths to accommodate a sloped ceiling.

7. The decorative support of claim 1, wherein the central downrod supports substantially all of the weight of the motor housing.

8. The decorative support of claim 7, wherein the central downrod is suspended so as to enable it to move with respect to the hangar, and wherein the perimeter downrods are self-adjusting to automatically fit a distance between the motor housing and the canopy.

9. The decorative support of claim 1, wherein each of the perimeter downrods is parallel to the central downrod.

10. A decorative support structure for a ceiling fan, comprising:

a motor housing;

an attachment device adapted for fixedly mounting on a ceiling; and a plurality of downrods connected to the motor housing and each separately connected to the attachment device at spaced apart locations thereon, wherein each downrod bears a proportional portion of the weight of the motor housing, and wherein each downrod has an adjustable length to accommodate a sloped ceiling, whereby each downrod must be adjusted to a different length from at least one other downrod in order for the motor housing to be level when the ceiling is sloped.

11. The support structure of claim 10, wherein the plurality of downrods comprises at least 4 downrods.

12. The decorative support structure of claim 10, wherein the downrods are parallel to each other.

13. A decorative support for a ceiling fan, comprising:

a motor housing;

an attachment device adapted for fixedly mounting on a ceiling;

a central downrod suspended from the attachment device at a first connection point and connected to the motor housing at a second connection point, wherein the central downrod supports substantially all of the weight of the motor housing; and a plurality of perimeter downrods connected to the attachment device at a corresponding plurality of first perimeter connection points spaced from the first connection point and to the motor housing at a corresponding plurality of second connection points spaced from the second connection point, wherein the central downrod is suspended so as to enable it to move with respect to the attachment device, and wherein the perimeter downrods are self-adjusting to automatically fit a distance between the motor housing and the attachment device.

14. The decorative support of claim 13, wherein the attachment device includes a hangar bracket and a decorative canopy around the hangar bracket, wherein the central downrod is suspended from the hangar bracket at the first connection point and the perimeter downrods are connected to the canopy at the first perimeter connection points.

15. The decorative support of claim 13, wherein the plurality of perimeter downrods comprises at least 4 downrods.

16. The decorative support of claim 13, wherein wires for supplying electrical power are routed through the central downrod.

17. The decorative support of claim 13, wherein wires for supplying electrical power are routed through at least one of the perimeter downrods.

18. The decorative support of claim 13, wherein each of the perimeter downrods is spaced the same distance from the central downrod.

19. The decorative support of claim 13, wherein each of the perimeter downrods is parallel to the central downrod.

* * * * *